US005245140A

United States Patent [19]

Wu

[11] Patent Number: 5,245,140

[45] Date of Patent: Sep. 14, 1993

[54] MUFFLER

[76] Inventor: Kan-Chiao Wu, P.O. Box 82-144, Taipei City, Taiwan, Taiwan

[21] Appl. No.: 871,835

[22] Filed: Apr. 20, 1992

[51] Int. Cl.[5] ..... F01N 7/02

[52] U.S. Cl. ..... 181/232; 181/272

[58] Field of Search ..... 181/232, 228, 227, 268, 181/272, 275

[56] References Cited

U.S. PATENT DOCUMENTS

| | | | |
|---|---|---|---|
| 1,984,707 | 12/1934 | Sommer | 181/275 |
| 3,306,395 | 2/1967 | Jettinghoff | 181/227 |
| 3,338,331 | 8/1967 | Jettinghoff | 181/227 |
| 3,807,527 | 4/1974 | Bergson et al. | 181/232 |
| 4,116,303 | 9/1978 | Trudell | 181/252 |
| 4,909,347 | 3/1990 | Wang | 181/272 |
| 4,924,966 | 5/1990 | Kanda et al. | 181/228 |

*Primary Examiner*—Michael L. Gellner
*Assistant Examiner*—Eddie C. Lee
*Attorney, Agent, or Firm*—Alfred Lei

[57] ABSTRACT

This invention relates to a muffler and in particular to one including a high frequency chamber, a first exhaust pipe connected between an engine and the high frequency chamber, a second exhaust pipe disposed within said high frequency, an intermediate frequency chamber connected with the other end of the second exhaust chamber, a third exhaust pipe disposed within the intermediate frequency chamber, a low frequency chamber connected with the other end of the third exhaust pipe, and a tubular pipe disposed within the low frequency chamber, whereby the noise will be effectively suppressed without decreasing the flow rate of the exhaust gas and the output power of the engine.

1 Claim, 3 Drawing Sheets 4
3
1
2

MUFFLER

BACKGROUND OF THE INVENTION

It is found that the prior art muffler has the following drawbacks:

1. The flow rate of the exhaust gas will be reduced thereby decreasing the output power of the engine.

2. Such muffler is made of asbestos or glass fiber which is harmful to the health.

Therefore, it is an object of the present invention to provide an improved muffler which may obviate and mitigate the above-mentioned drawbacks.

SUMMARY OF THE INVENTION

This invention relates to an improved muffler.

It is the primary object of the present invention to provide a muffler which applies the principle of resonance to suppress the noise of the exhaust gas.

It is another object of the present invention to provide a muffler which will not decrease the flow rate of the exhaust gas and the output power.

It is still another object of the present invention to provide a muffler which is simple in construction.

It is still another object of the present invention to provide a muffler which is economic to produce.

It is a further object of the present invention to provide a muffler which does not use asbestos or glass fiber as the manufacturing material.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
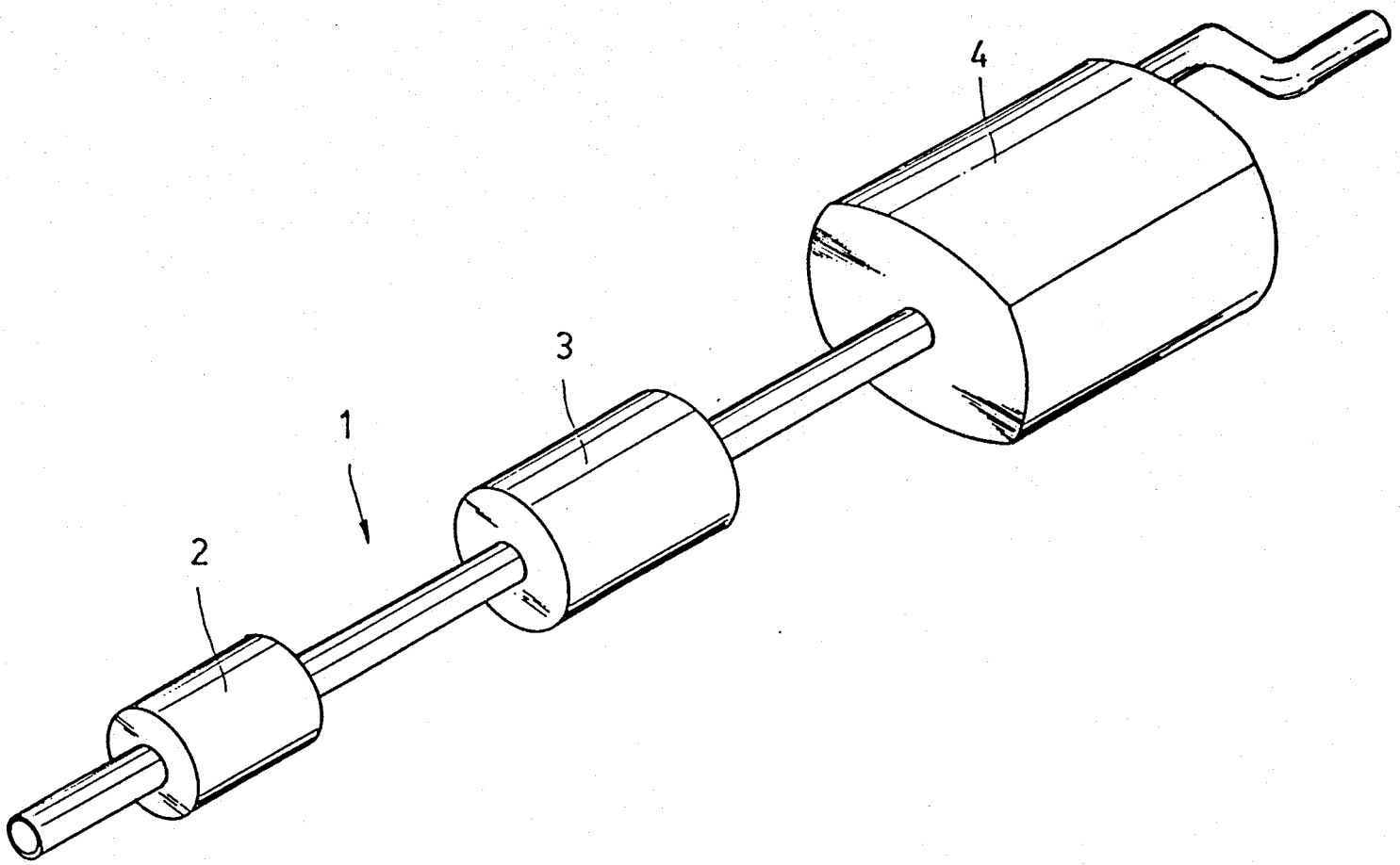
FIG. 1 is a perspective view of a muffler according to the present invention.

With reference to the drawings and in particular to FIG. 1 thereof, the muffler according to the present invention mainly comprises a high frequency chamber 2, an intermediate frequency chamber 3, and a lower frequency chamber 4.

Figure 2:
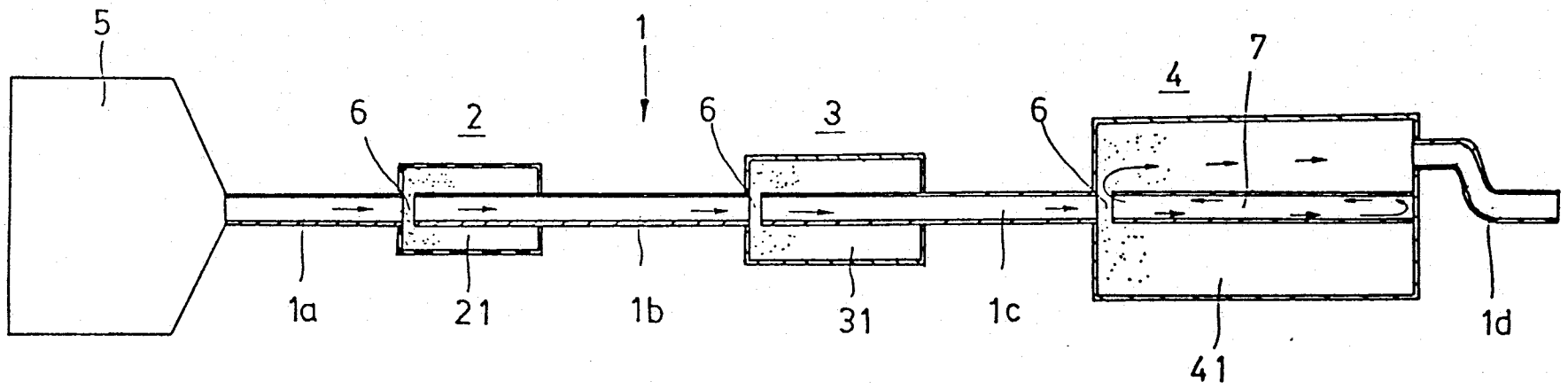
FIG. 2 is a sectional view of the muffler.
Figure 3:
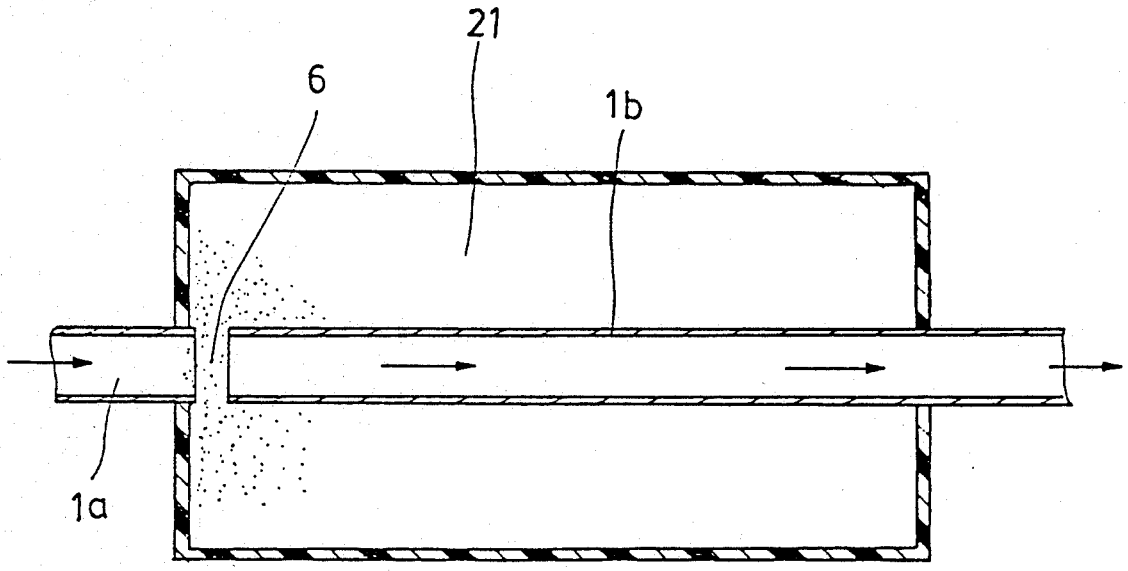
FIG. 3 shows the principle of the present invention.

Looking now at FIG. 2, the high frequency chamber 2 is connected with a first exhaust pipe 1*a* of an engine 5. The diameter of a first exhaust pipe 1*a* depends upon the output power of the engine 5. Within the high frequency chamber 2 there is a second exhaust pipe 1*b* which extends out of the high frequency chamber 2 to connect with the intermediate frequency chamber 3. Between the first exhaust pipe 1*a* and the second exhaust pipe 1*b* there is a clearance 6. Within the intermediate frequency chamber 3 there is a third exhaust pipe 1*c* which extends out of the intermediate frequency chamber 3 to connect with the lower frequency chamber 4. Between the second exhaust pipe 1*b* and the third exhaust pipe 1*c* there is a clearance 6. Within the low frequency chamber 4 there is a tubular pipe 7. Between the third exhaust pipe 1*c* and the tubular pipe 7 there is a clearance 6. Further, a fourth exhaust pipe 1*d* is provided on the rear end of the low frequency chamber 4.

As the exhausted gas passes through the chambers 2, 3 and 4, resonance will be produced therein hence suppressing the noise. Generally, if the diameter of the exhaust pipe 1*a*, 1*b* and 1*c* is 4 cm, then it is preferred to provide a clearance between 0.5–1.5 cm.

Experiment:

| | NOISE PRODUCED BY COROLLA | NOISE PRODUCED BY COROLLA WITH THE PRESENT INVENTION | NOISE DECREASED |
|---|---|---|---|
| 700 RPM | 62 dB | 59 dB | 3 dB |
| 2000 RPM | 74 dB | 70 dB | 4 dB |
| 3000 RPM | 79 dB | 75 dB | 4 dB |

From the above, the noise decreaded by the present invention is 3 dB at least, i.e. the noise is decreased by one-half.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A muffler comprising:

a high frequency chamber having an inlet at one end and an outlet at another end;

a first exhaust pipe connected between an engine and the inlet of said high frequency chamber;

a second exhaust pipe coaxial with said first exhaust pipe, disposed within said high frequency chamber and having an inner end with a distance from said first exhaust pipe and an outer end extending out of the outlet of said high frequency chamber;

an intermediate frequency chamber having an inlet at one end and an outlet at another end, the inlet of said intermediate frequency chamber being connected with the outer end of said second exhaust pipe;

a third exhaust pipe coaxial with said second exhaust pipe, disposed within said intermediate frequency chamber and having an inner end with a distance from said second exhaust pipe and an outer end extending out of the outlet of said intermediate frequency chamber;

a low frequency chamber having an inlet at one end and an outlet at another end, the inlet of said low frequency chamber being connected with the outer end of said third exhaust pipe;

a tubular pipe coaxial with said third exhaust pipe, disposed within said low frequency chamber and having an outer end with a distance from the outer end of said third exhaust pipe and an inner end fixedly mounted on an inner end side of said low frequency chamber to form a closed bottom; and a fourth exhaust pipe connected with the outlet of said low frequency chamber and not coaxial with said third exhaust pipe.

* * * * *